US006644784B2

(12) United States Patent
Van Veen et al.

(10) Patent No.: US 6,644,784 B2
(45) Date of Patent: Nov. 11, 2003

(54) METHOD AND APPARATUS FOR PRINTING WITH MULTIPLE RECORDING MECHANISMS

(75) Inventors: Mark Andreas Van Veen, Cardiff by the Sea, CA (US); Jaime E. Dorman, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/984,534

(22) Filed: Oct. 30, 2001

(65) Prior Publication Data

US 2003/0081094 A1 May 1, 2003

(51) Int. Cl.[7] ..... B41J 2/135; B41J 2/045; B41J 2/01

(52) U.S. Cl. ..... 347/44; 347/68; 347/101

(58) Field of Search ..... 347/96, 98, 101, 347/68–72, 44

(56) References Cited

U.S. PATENT DOCUMENTS 5,081,596 A * 1/1992 Vincent et al. ..... 358/1.4
6,254,230 B1 * 7/2001 Wen et al. ..... 347/101
6,513,897 B2 * 2/2003 Tokie ..... 347/15

* cited by examiner

*Primary Examiner*—Benjamin R. Fuller
*Assistant Examiner*—Michael S Brooke
(74) *Attorney, Agent, or Firm*—Lee & Hayes, PLLC

(57) ABSTRACT

A printer device contains a combination of variously configured mechanisms for delivering recording information onto a recording medium. For example, the printer device contains both thermal inkjet printheads and piezoelectric printheads. In this example, each of the thermal inkjet printheads and piezoelectric printheads are connected to separate fluid supplies to thereby enable each of the printheads to eject fluids having various characteristics onto a recording medium. Thus, the various fluids may be applied onto the recording medium from both the thermal inkjet printheads and the piezoelectric printheads in a substantially continuous manner during a single printing operation to thereby increase both throughput and printing options.

10 Claims, 4 Drawing Sheets

METHOD AND APPARATUS FOR PRINTING WITH MULTIPLE RECORDING MECHANISMS

FIELD OF THE INVENTION

This invention relates generally to inkjet printer devices. More specifically, the present invention pertains to a printing device composed of both multiple recording mechanisms for printing images onto recording media.

BACKGROUND OF THE INVENTION

It is generally known to record information on recording media, e.g., paper, textiles, fabric, mylar, transparencies, and the like, by discharging ink and depositing it onto the recording media. According to one type of inkjet printer, ink is typically supplied substantially continuously over a plurality of resistors generally located beneath the openings of the nozzles. In use, certain of the resistors are activated, i.e., heated, to rapidly heat a component in the ink above its boiling point causing vaporization of the ink component resulting in ejection of a drop of the ink. According to another type of inkjet printer, ink is typically supplied substantially continuously over a plurality of piezoelectric elements located beneath the openings of the nozzles. In this type of printer, certain of the piezoelectric elements are caused to deform at a relatively rapid rate, thereby generating a compressive force causing the ink to be ejected.

The selection of either thermal inkjet systems or piezoelectric systems is often based upon the respective printing capabilities of each system. For example, thermal inkjet systems are typically characterized as having a relatively high nozzle packing and nozzle count. One result of this type of configuration is that a relatively high resolution, e.g., 600 dpi or more, may be achieved through use of the thermal inkjet systems. One drawback to thermal inkjet systems is the relative high cost of ink, especially for non-standard colors. Thermal inkjet systems typically require the ink to contain small particle sizes with a certain water content level to achieve the necessary print quality. As a result, ink manufacturers can produce the non-standard ink colors but these inks are relatively specialized and in small demand. Accordingly, the non-standard ink colors are relatively difficult and expensive to obtain.

Piezoelectric systems are oftentimes selected when resolution is relatively less important and/or when it is desired to print with specialized inks. For example, piezoelectric systems may be selected when it is desired to print spot colors, e.g., colors that are premixed prior to printing on print media. In addition, piezoelectric systems may utilize a relatively wider array of inks because they do not vaporize ink to eject it through the nozzles. Piezoelectric systems are typically capable of using inks having a much larger range of viscosities and may handle a larger range of rheologies as compared to thermal inkjet systems. Thus, it may be possible to use existing inks in piezoelectric systems. For example, piezoelectric systems may use inks currently utilized in conventional silkscreen textile printing.

One drawback to piezoelectric systems is that it is relatively difficult and expensive to pack a substantially large number of nozzles onto a printhead. One result of the relatively low number of nozzles in piezoelectric systems is that throughput is oftentimes compromised in comparison to the use of thermal inkjet systems. For example, conventional piezoelectric systems may include nozzle packing equivalent to 180 dots per inch (dpi), whereas conventional thermal inkjet systems may include nozzle packing equivalent to 600 dpi. In one respect, the lower nozzle packing and nozzle count in piezoelectric systems equates to a higher per nozzle cost for piezoelectric systems in comparison to thermal inkjet systems. In another respect, the lower resolution printing capability of piezoelectric systems oftentimes renders it more difficult to print smooth transitions between colors as compared to thermal systems. Furthermore, it may be relatively difficult to print features such as text and line art at relatively high resolutions because of the occurrences of rough edges and poor readability.

SUMMARY OF THE INVENTION

According to an aspect, the present invention pertains to a printer device. The printer device includes a first recording mechanism operable to deliver a first recording material to a recording medium according to a first manner. The printer device also includes a second recording mechanism operable to deliver a second recording material to the recording medium according to a second manner. The second manner of delivery of the second recording material from the second recording mechanism is substantially different than the first manner of delivery of the first recording material from the first recording mechanism.

According to another aspect, the present invention pertains to a method for printing onto a recording medium. In the method, a first recording material is applied onto the recording medium with a first recording mechanism and a second recording material is also applied onto the recording medium with a second recording mechanism. In addition, the manner of applying the first recording material substantially differs from the manner of applying the second recording material.

In comparison to known printing mechanisms and techniques, certain embodiments of the invention are capable of achieving certain advantages, including some or all of the following: (1) greater flexibility in the types of recording materials useable in the printing mechanism; (2) greater number of printing options; (3) increased throughput by enabling printing with various types of recording mechanisms during a single printing operation. Those skilled in the art will appreciate these and other advantages and benefits of various embodiments of the invention upon reading the following detailed description of a preferred embodiment with reference to the below-listed drawings.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

Figure 1:
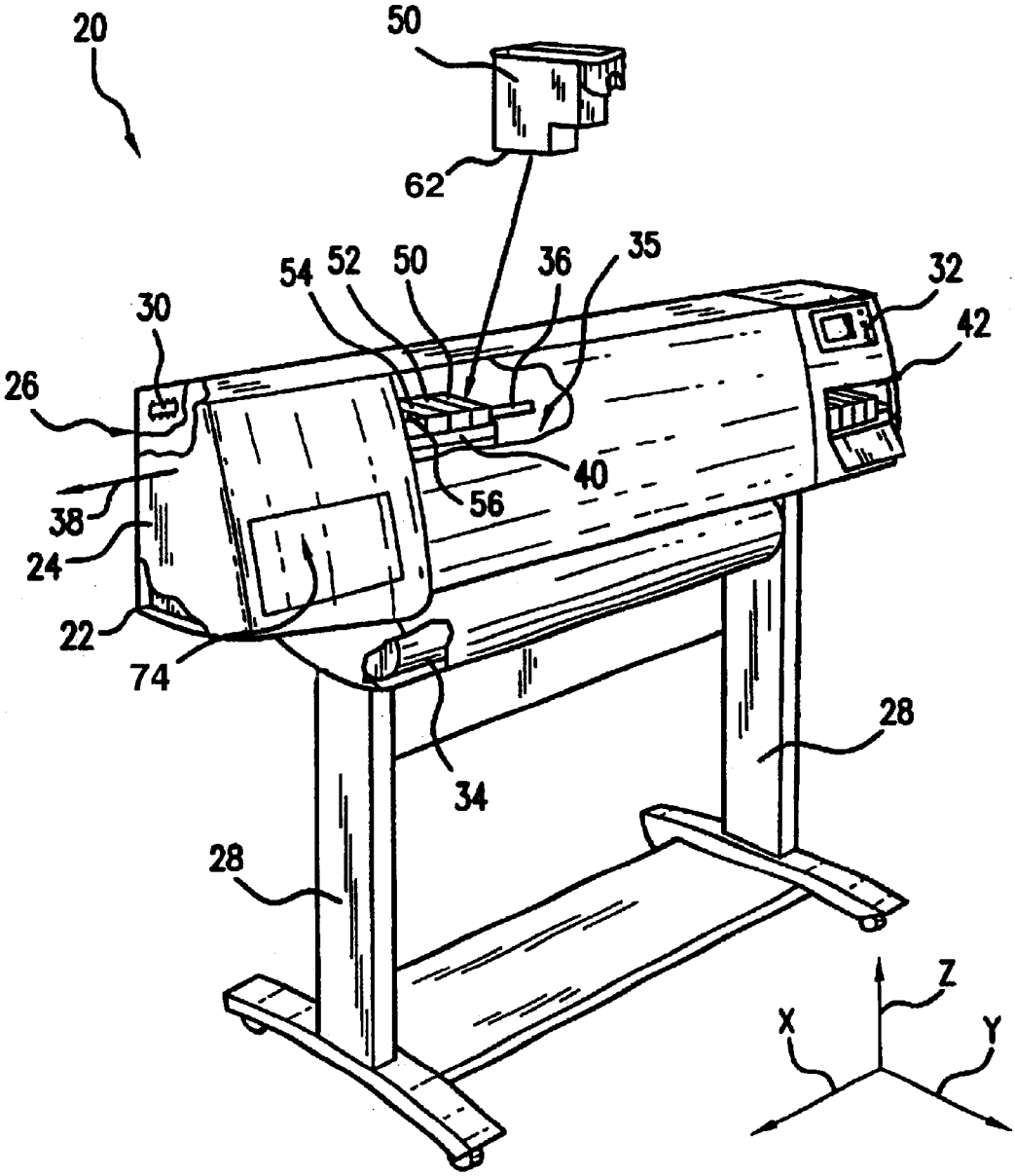
FIG. 1 illustrates an embodiment of a printer constructed in accordance with the principles of the present invention.

For simplicity and illustrative purposes, the principles of the present invention are described by referring mainly to an exemplary embodiment thereof. In the following description, numerous specific details are set forth in order to provide a thorough understanding of the present invention. It will be apparent however, to one of ordinary skill in the art, that the present invention may be practiced without limitation to these specific details. In other instances, well known methods and structure have not been described in detail so as not to unnecessarily obscure the present invention.

According to the principles of the present invention, a printer device is capable of printing with a combination of variously configured mechanisms (e.g., thermal inkjet printheads, piezoelectric printheads, acoustic activation printheads, toner cartridges, dot matrix printers, lithographic printers, gravure printers, etc.) for delivering recording information onto a recording medium, Although it may be possible to arrange various types of mechanisms for delivering recording information together in a printer device, for purposes of simplicity, the principles of the present invention are set forth by way of example to a printer device including at least one thermal inkjet printhead and at least one piezoelectric printhead. It should be understood, therefore, that the principles of the present invention are not limited to the descriptions of the printer device enumerated in the present disclosure, rather, they may be applied in any printer device that combines more than one recording information delivery mechanism.

In addition the present invention is not limited to printing mechanisms configured to scan over a sheet of media. Instead, the principles of the present invention may equally be applicable to non-scanning arrays of printing mechanisms. A non-scanning array may be defined as an array of printing mechanisms that is not configured to scan across a sheet of media. Instead, the printing mechanisms constituting the non-scanning array are maintained at a relatively fixed position and the sheet of media may be caused to translate with respect to the printing mechanisms.

According to a preferred embodiment, the printer device of the present invention, more specifically, the thermal inkjet printheads and piezoelectric printheads may be connected to separate ink supplies to thereby enable each of the printheads to eject fluids (e.g., dyes, pigments, undercoats, overcoats, etc.) having various characteristics onto a recording medium. Examples of the various characteristics of the fluids may include, color, viscosity, pigment content, and the like.

In addition, an embodiment of the present invention enables the use of variously priced and available fluids. For example, for relatively higher quality printing, a more expensive, and/or a custom color ink could be used with the thermal inkjet printheads, whereas, for relatively lower quality printing, a generally less expensive ink and more readily available ink could be used with the piezoelectric printheads.

FIG. 1 illustrates an embodiment of a printer 20 constructed in accordance with the principles of the present invention, which may be used for recording information onto a recording medium, such as, paper, textiles, and the like, in an industrial, office, home or other environment. The present invention may be practiced in a variety of printers. For instance, it is contemplated, although not limited to, that an embodiment of the present invention may be practiced in large scale textile printers, desk top printers, portable printing units, copiers, cameras, video printers, and facsimile machines, to name a few. For convenience, the concepts of the present invention are illustrated in the environment of the printer 20.

While it is apparent that the printer components may vary from model to model, the printer 20 includes a chassis 22 surrounded by a housing or casing enclosure 24, typically of a plastic material, together forming a print assembly portion 26 of the printer 20. Additionally, the print assembly portion 26 may be supported by a desk or tabletop, however, it is preferred to support the print assembly portion 26 with a pair of leg assemblies 28. The printer 20 also has a printer controller 30, illustrated schematically as a microprocessor, that receives instructions from a host device (not shown), typically a computer, such as a personal computer or a computer aided drafting (CAD) computer system. The printer controller 30 may also operate in response to user inputs provided through a key pad and a status display portion 32, located on the exterior of the casing 24. A monitor coupled to the host device may also be used to display visual information to an operator, such as the printer status or a particular program being run on the host device. Personal and drafting computers, their input devices, such as a keyboard and/or a mouse device, and monitors are all well known to those skilled in the art.

A conventional recording media handling system (not shown) may be used to advance a continuous sheet of recording media 34 from a roll through a print zone 35. The recording media may be any type of suitable sheet material, such as paper, poster board, fabric, transparencies, mylar, vinyl, and the like. A carriage guide rod 36 is mounted to the chassis 22 to define a scanning axis 38, with the guide rod 36 slideably supporting a carriage 40 for travel back and forth, reciprocally, across the print zone 35. A conventional carriage drive motor (not shown) may be used to propel the carriage 40 in response to a control signal received from the controller 30. To provide carriage positional feedback information to controller 30, a conventional metallic encoder strip (not shown) may be extended along the length of the print zone 35 and over a servicing region 42.

A conventional optical encoder reader may be mounted on the back surface of carriage 40 to read positional information provided by the encoder strip, for example, as described in U.S. Pat. No. 5,276,970, also assigned to Hewlett-Packard Company, the assignee of the present invention and hereby incorporated by reference in its entirety. The manner of providing positional feedback information via the encoder strip reader, may also be accomplished in a variety of ways known to those skilled in the art. Upon completion of printing an image, the carriage 40 may be used to drag a cutting mechanism across the final trailing portion of the media to sever the image from the remainder of the roll 34. Suitable cutter mechanisms are commercially available in the DesignJet.RTM. 650C and 750C color printers. Of course, sheet severing may be accomplished in a variety of other ways known to those skilled in the art. Moreover, the illustrated printer 20 may also be used for printing images on pre-cut sheets, rather than on media supplied in a roll 34.

Figure 2:
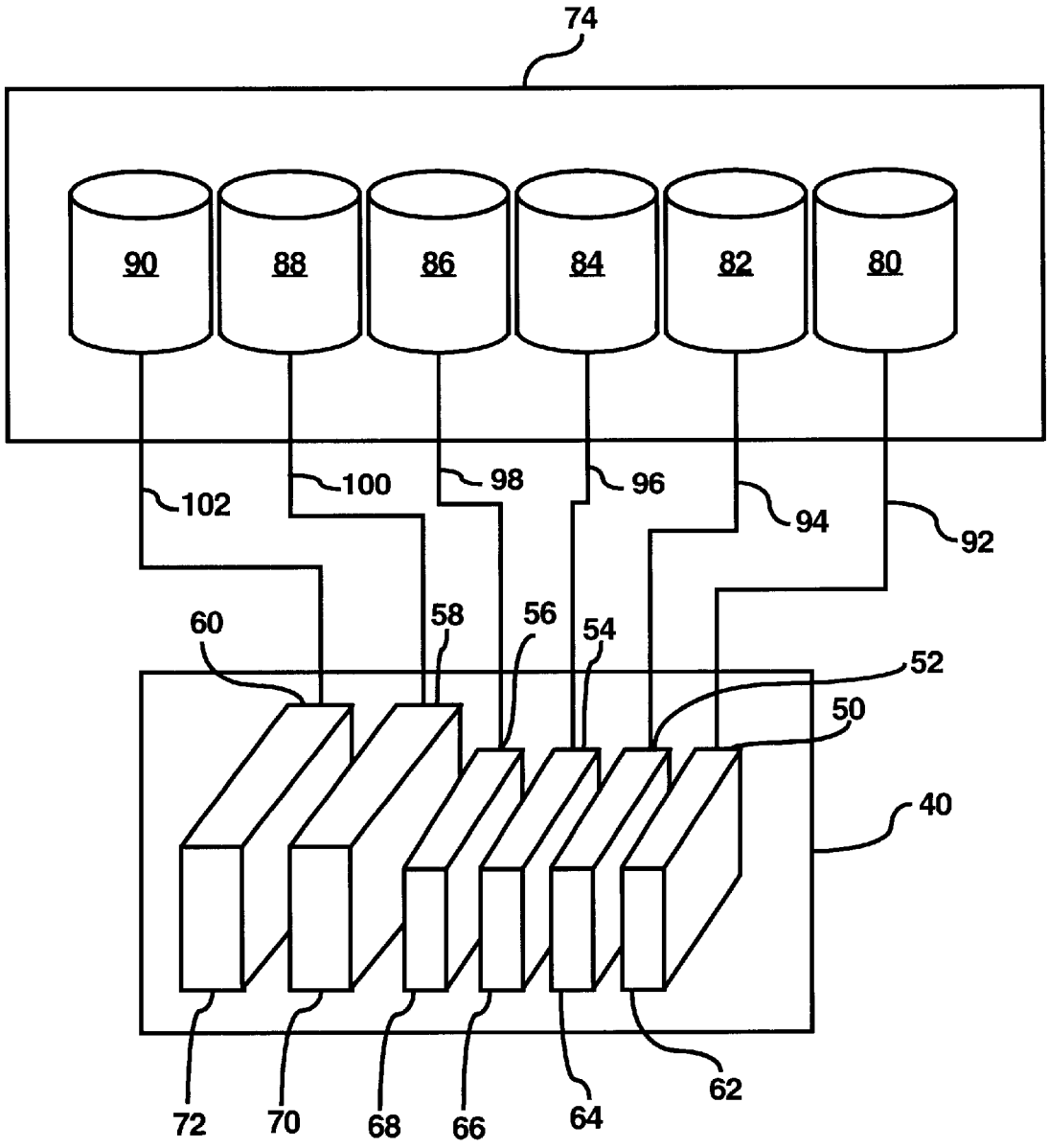
FIG. 2 is an enlarged perspective view of a plurality of printheads and reservoirs according to the principles of the present invention.

As more clearly illustrated in FIG. 2, the printer 20 contains six cartridges 50–60. In the print zone 35, the recording medium receives ink from cartridges 50–60. The cartridges 50–60 are also often called "pens" by those in the art. One of the pens, for example pen 50, may be configured to eject black ink onto the recording medium, where the black ink may contain a pigment-based ink. Pens 52–60 may be configured to eject variously colored inks, e.g., yellow, magenta, cyan, light cyan, light magenta, blue, green red, to name a few. For the purposes of illustration, pens 52–60 are described as each containing a dye-based ink of the colors yellow, magenta and cyan, respectively, although it is apparent that the color pens 52–60 may also contain pigment-based inks in some implementations. It is apparent that other types of inks may also be used in the pens 50–60, such as paraffin-based inks, hybrid or composite inks having both dye and pigment characteristics, MEK, alcohol based inks, etc.

The printer 20 uses an "off-axis" ink delivery system, having main stationary reservoirs 80–90 for each ink (black, cyan, magenta, yellow) located in an ink supply region 74. In this respect, the term "off-axis" generally refers to a configuration where the ink supply is separated from the print heads 50–60. In this off-axis system, the pens 50–60 may be replenished by ink conveyed through a series of flexible tubes 92–102 from the main stationary reservoirs 80–90 so only a small ink supply is propelled by carriage 40 across the print zone 35 which is located "off-axis" from the path of printhead travel. Some or all of the main stationery reservoirs 80–90 may be located in a region generally away from the interior of the printer 20. In addition, the number of main stationary reservoirs 80–90 may vary from that illustrated in FIG. 2 and is not necessarily required to equal the number of cartridges 50–60 utilized in the printer 20. In this respect, the printer 20 may include a lesser or greater number of reservoirs 80–90 than the number of cartridges 50–60. As used herein, the term "pen" or "cartridge" may also refer to replaceable printhead cartridges where each pen has a reservoir that carries the entire ink supply as the printhead reciprocates over the print zone.

The illustrated pens 50–60 have printheads 62–72, respectively, which selectively eject ink to form an image on a sheet of media 34 in the print zone 35. These printheads 62–72 have a large print swath, for instance about 20 to 25 millimeters (about one inch) wide or wider, although the printhead maintenance concepts described herein may also be applied to smaller printheads. The printheads 62–72 each have an orifice plate with a plurality of nozzles formed there through in a manner well known to those skilled in the art.

The nozzles of each printhead 62–72 are typically formed in at least one, but typically two linear arrays along the orifice plate (not shown). Thus, the term "linear" as used herein may be interpreted as "nearly linear" or substantially linear, and may include nozzle arrangements slightly offset from one another, for example, in a zigzag arrangement. Each linear array is typically aligned in a longitudinal direction substantially perpendicular to the scanning axis 38, with the length of each array determining the maximum image swath for a single pass of the printhead.

The cartridges 50–56 comprise thermal inkjet printheads 62–68 and the cartridges 58 and 60 comprise piezoelectric printheads 70 and 72. The piezoelectric cartridges 70 and 72 are illustrated as being relatively larger than the thermal inkjet cartridges 50–56 for purposes of illustration only. In this regard, the piezoelectric cartridges 70 and 72 may comprise the same size or a smaller size that the thermal inkjet cartridges 50–56. The quantity and position of the thermal inkjet printheads 62–68 and the piezoelectric printheads 70–72 shown in FIG. 2 are for illustrative purposes only and are thus not meant to limit the present invention in any respect. Thus, the present invention may include any reasonably suitable quantity of either type of printhead, with the printheads being arranged in any reasonably suitable configuration. Printers that implement thermal inkjet printheads and are often referred to as thermal inkjet printers to those in the art. In addition, printers that implement piezoelectric printheads are often referred to as piezoelectric printers in the art.

The thermal inkjet printheads 62–68 include a plurality of resistors (not shown) which are associated with the nozzles. Upon energizing a selected resistor, a bubble of gas is formed which ejects a droplet of ink from the nozzle and onto a sheet of print media in the print zone 35 under the nozzle. The resistors are selectively energized in response to firing command control signals delivered from the controller 30 to the printhead carriage 40. One characteristic of thermal inkjet printheads is that they often contain nozzles having relatively small diameters and is thus capable of containing a relatively large number of nozzles. In addition, the types and chemical composition of fluids that may be utilized in thermal inkjet printers are often limited to water based inks (e.g., to enable bubble nucleation of the ink by the resistors) containing relatively low viscosities. Furthermore, due to the relatively sensitive nature of the inks used in thermal inkjet printheads, it is relatively important to maintain a certain level of quality and consistency in these types of fluids, oftentimes resulting in increased manufacturing costs. Because of the expenses involved in the manufacture of these types of fluids, the colors of suitable fluids are often relatively limited and spot colors, e.g., colors that are premixed prior to printing, are not often manufactured for use in thermal inkjet printers.

At least by virtue of the printhead resistor configuration, the thermal inkjet printheads 62–68 are typically characterized as being capable of printing at relatively high resolutions, e.g., 600 dpi or greater. In addition, the thermal inkjet printheads 62–68 are configured to print one of at least four colors, respectively. These colors are typically cyan (C), magenta (M), yellow (Y), and black (B). Moreover, the thermal inkjet printheads 62–68 may also be configured to print other colors, such as light cyan (C1) and light magenta (M1). Because these colors are relatively standard for thermal inkjet printers, they are in relatively large supply and are thus relatively easily obtained. In addition, fluids having these colors may be manufactured at higher and stricter standards. In use, when a printing operation requires colors other than those enumerated above, thermal inkjet printers typically combine at least two of these colors during the printing process to create what are known as "process colors".

The piezoelectric printheads 70 and 72 include a plurality of piezoelectric elements (not shown), associated with the nozzles. The piezoelectric elements are selectively energized in response to firing command signals delivered from the controller 30 to the printhead carriage 40. Current manufacturing processes for fabricating thermal inkjet printheads allow for greater nozzle packing than manufacturing processes implemented for piezoelectric printheads. Therefore, piezoelectric printers are typically unable to print at as high a resolution as thermal inkjet printers. Some printing devices implement multiple offset piezoelectric printheads to create higher resolution printing. However, these printing devices are generally more expensive to manufacture and generally require a greater amount of space.

Generally speaking, the piezoelectric printheads 70 and 72 are capable of utilizing a relatively wider array of fluid as compared to thermal inkjet printheads at least by virtue of its ability to use non-water based inks and its ability to eject ink without having to boil the ink. In this regard, the piezoelectric printheads 70 and 72 may use fluids having a much larger range of viscosities and may handle a larger range of rheologies as compared to thermal inkjet printers. Although the piezoelectric printheads 70 and 72 may utilize fluids that may be combined to create process colors, spot color fluids may also be used without relatively major complications. In this respect, the manufacturing costs associated with the fabrication of the fluids suitable for use in the piezoelectric printheads 70 and 72 may be relatively less than those associated with fluids suitable for use in the thermal inkjet printheads 62–68.

In addition, the ability of the piezoelectric printheads 70 and 72 to utilize fluids having larger particle sizes as well as its compatibility with various ink compositions, generally enables a substantial flexibility in the types of fluids that may be fired through the nozzles. In this respect, spot colors for use with piezoelectric printheads 70 and 72 are generally more available and more cost-effective as compared to spot color fluids configured for use with the thermal inkjet printheads 62–68. Furthermore, the piezoelectric printheads 70 and 72 may be capable of using fluids already in existence for use in other types of printing operations. For example, the piezoelectric printheads 70 and 72 may be capable of using fluids currently utilized in conventional silkscreen textile printing. The ability of the piezoelectric printheads 70 and 72 to utilize pre-existing and widely available inks generally increases its flexibility, including the color gamut available for use during printing operations.

In addition to the above, the piezoelectric printheads 70 and 72 may be implemented to apply fluids other than colored inks. For example, the piezoelectric printheads 70 and 72 may be implemented to apply an opaque undercoat, a post-printing coating, and the like. Moreover, the piezoelectric printheads 70 and 72 may be implemented to apply background colors that do not require as high a resolution as compared to colors printed by the thermal inkjet printheads 62–68. Furthermore, the piezoelectric printheads 70 and 72 may be implemented to apply other types of fluids that may enable the printed colors on the print media to have other beneficial characteristics, e.g., wash fastness, color fastness, abrasion resistance, etc. In this regard, the piezoelectric printheads 70 and 72 may be implemented to apply fluids onto the print medium in addition to those specifically designed for aesthetic purposes.

Moreover, for example, in the textile printing industry, certain types of fabrics may require the use of inks containing acid dyes and/or pigments. Although these types of inks may be relatively incompatible with the thermal inkjet printheads 62–68, they may be implemented with the piezoelectric printheads 70 and 72 with relative ease.

In operation, the main stationary reservoirs 80–86 may contain fluids for use with the thermal inkjet printheads 62–68 and the reservoirs 88 and 90 may contain fluids for use with the piezoelectric printheads 70 and 72. The reservoirs 80–86 may contain the fluids described above for use with the thermal inkjet printheads 62–68 and may either be replenished or replaced as the fluid contained therein is depleted. The reservoirs 88 and 90 may contain the fluids described above for use with the piezoelectric printheads 70 and 72 and may also be either replenished or replaced as in the fluid contained therein is depleted. In addition, the reservoirs 88 and 90 may be configured to contain various types of fluids, such that the fluids applied to the print media may be varied as desired. For example, the reservoirs 88 and 90 may be cleaned with a flushing solution after depletion of one color and another color may then be inserted into the reservoirs.

In general, by virtue of the principles of the present invention, higher quality printing may be accomplished through use of the thermal inkjet printheads 62–68 and lower quality printing may be accomplished through use of the piezoelectric printheads 70 and 72. In addition, the piezoelectric printheads 70 and 72 may be implemented to print spot colors or background colors. The piezoelectric printheads 70 and 72 may also be implemented to print other types of fluids to generally enhance or provide other qualities to a printed image, e.g., various finishes, fade resistance, etc. Moreover, the printer device 20 may be implemented to perform conventional printing operations with either the piezoelectric printheads 70 and 72 or the thermal inkjet printheads 62–68.

In addition to the above, the piezoelectric printheads 70 and 72 may be implemented to print pre-coats and post-coats on the print media. For example, if a certain printing characteristic is desired, e.g., light water fastness, but the fluid necessary to create the image characteristic is incompatible with the thermal inkjet printheads 62–68, the necessary fluid may be fired from the piezoelectric printheads 70 and 72. In this respect, the ink from the thermal inkjet printheads 62–68 may receive a post-coat to achieve a desired printing characteristic.

As another example, a piezoelectric printhead 70 may be provided on one side of the thermal inkjet printheads 62–68 and another piezoelectric printhead 72 may be provided on the other side of the thermal inkjet printheads. In this configuration, one of the piezoelectric printheads 70 and 72 may be implemented to provide a pre-coat, e.g., to increase the drying time for ink applied by the thermal inkjet printheads 62–68, to increase the bond between the ink and the print media, and the like. The other of the piezoelectric printheads 70 and 72 may be implemented to provide a post-coat, e.g., a glossy finish, a film laminate, and the like. In a process implementing this example, along a printing pass, for instance, one of the piezoelectric printheads 70 and 72 may first apply a pre-coat over which the thermal inkjet printheads 62–68 may apply ink, with the other of the piezoelectric printheads applying a post-coat over the ink and the pre-coat.

Figure 3:
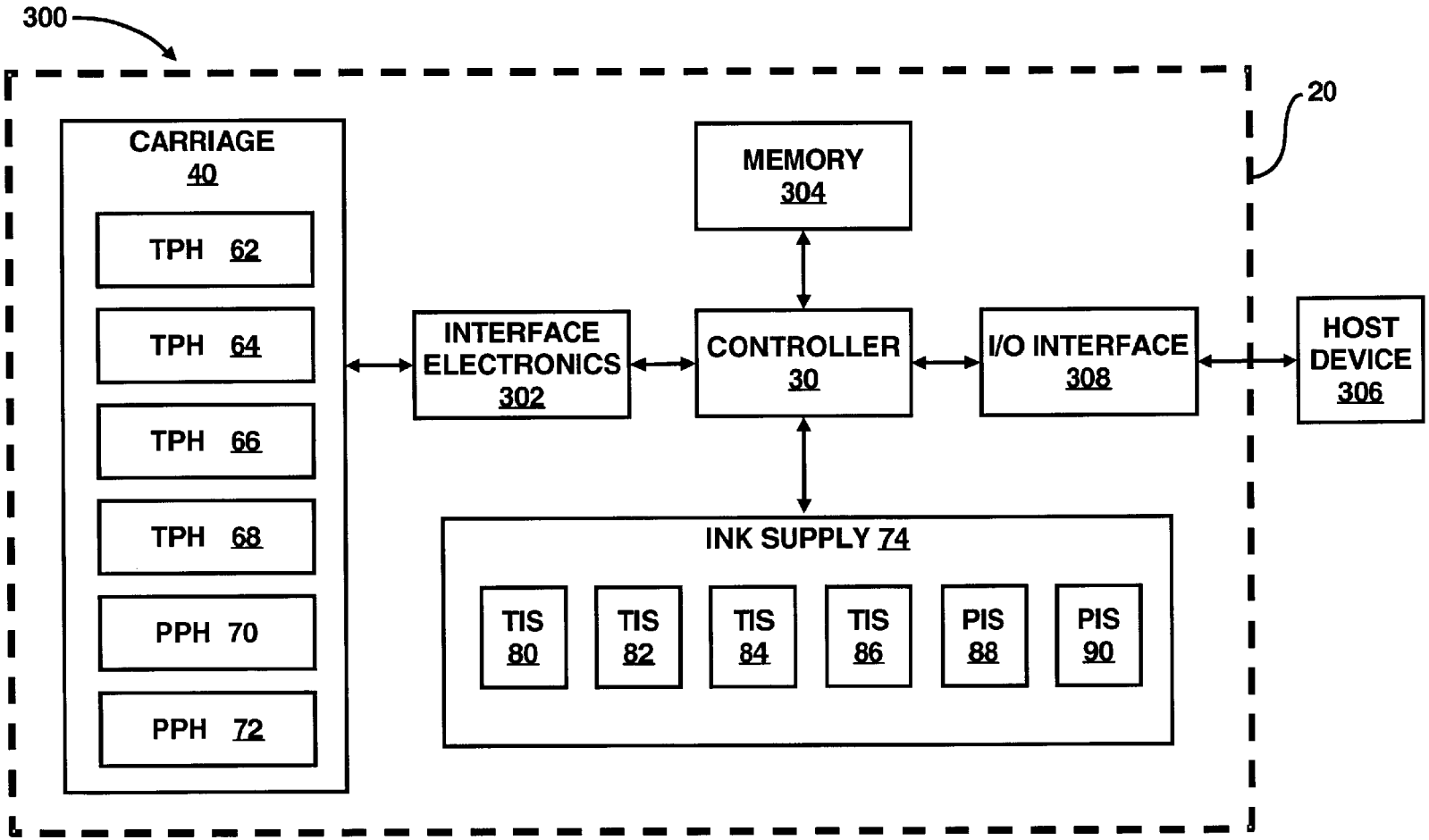
FIG. 3 is an exemplary block diagram of a printing mechanism in accordance with an embodiment of the present invention.

Referring to FIG. 3, there is illustrated an exemplary block diagram 300 of the printer 20 in accordance with an embodiment of the present invention. As will become better understood from a reading of present disclosure, the following description of the block diagram 300 illustrates one manner in which a printer 20 having both thermal inkjet printheads ("TPH") 62–68 and piezoelectric printheads ("PPH") 70 and 72 may be operated in accordance with an embodiment of the present invention. In this respect, it is to be understood that the following description of FIG. 3 is but one manner of a variety of different manners in which such a printer 20 may be operated.

Generally speaking, the printer 20 includes TPHs 62–68 and PPHs 70 and 72. Although FIG. 3 illustrates four TPHs 62–68 and two PPHs 70 and 72, the present invention may include any reasonably suitable number of either of these types of printheads. For example, the printer 20 may include five TPHs and three PPHs.

The printer 20 may also include interface electronics 302 configured to provide an interface between the controller 30 of the printer 20 and the components for moving the carriage 40, e.g., encoder, belt and pulley system (not shown), etc. The interface electronics 302 may include, for example, circuits for moving the carriage, the medium, firing individual nozzles of each printhead, and the like.

The controller 30 may be configured to provide control logic for the printer 20, which provides the functionality for the printer. In this respect, the controller 30 may be implemented by the microprocessor as mentioned above as well as, a micro-controller, an application specific integrated circuit, and the like. The controller 30 may be interfaced with a memory 304 configured to provide storage of a computer software that provides the functionality of the printer 20 and may be executed by the controller. The memory 304 may also be configured to provide a temporary storage area for data/file received by the printer 20 from a host device 306, such as a computer, server, workstation, and the like. The memory 304 may be implemented as a combination of volatile and non-volatile memory, such as dynamic random access memory ("RAM"), EEPROM, flash memory, and the like. It is, however, within the purview of the present invention that the memory 304 may be included in the host device 306.

The controller 30 is further interfaced with an I/O interface 308 configured to provide a communication channel between a host device 306 and the printer 20. The I/O interface 308 may conform to protocols such as RS-232, parallel, small computer system interface, universal serial bus, etc. In addition, the controller 30 may be interfaced with an ink supply section 74 containing a plurality of reservoirs 80–90. While the controller 30 may be configured to operate the flow of fluid from the reservoirs 80–90 contained in the ink supply section 74 to each of the printheads 62–72, the controller may also be configured to receive information regarding the type of fluid contained in each reservoir 80–90 and their respective levels. This information may be utilized, for instance, by the controller 30 in determining whether sufficient quantities of the fluids are available to complete a pending printing operation.

Each of the reservoirs 80–90 may be configured to hold and supply a respective one of the printheads 62–72 with recording material. In this respect, reservoirs 80–86 ("TISs") may be configured to supply fluid to the TPHs and reservoirs 88 and 90 ("PISs") may be configured to supply fluid to the PPHs. As described hereinabove, the TISs may contain ink configured to be compatible with the TPH's and the PIS's may contain fluid (e.g., ink) configured to be compatible with the PPHs.

Figure 4A:
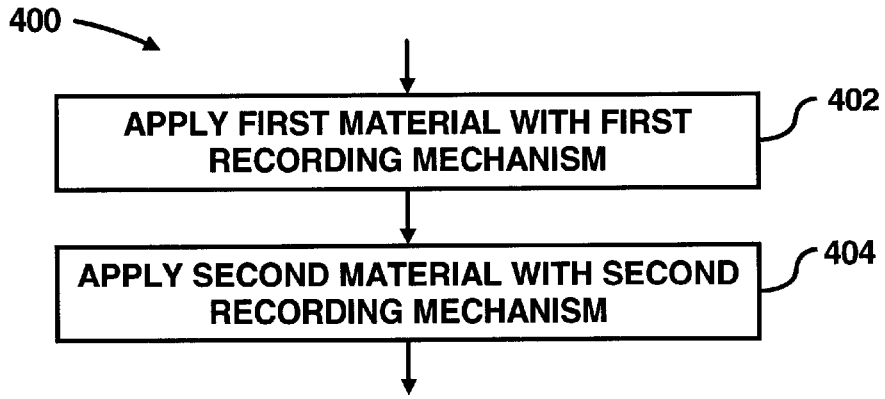
FIGS. 4A–4C are respective exemplary flow diagrams illustrating various manners in which embodiments of the present invention may be practiced.

Referring to FIG. 4A, there is illustrated an exemplary flow diagram 400 of a simplified manner in which the principles of the present invention may be practiced. It is to be understood that the steps illustrated in the flow diagram 400 may be contained as a utility, program, subprogram, in any desired computer accessible medium. In addition, the flow diagram 400 may be embodied by a computer program, which can exist in a variety of forms both active and inactive. For example, they can exist as software program(s) comprised of program instructions in source code, object code, executable code or other formats. Any of the above can be embodied on a computer readable medium, which include storage devices and signals, in compressed or uncompressed form.

Exemplary computer readable storage devices include conventional computer system RAM (random access memory), ROM (read only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. Although particular reference is made in the following description of FIG. 4A to the controller 30 as performing certain printer functions, it is to be understood that those functions may be performed by any electronic device capable of executing the above-described functions.

As illustrated in FIG. 4A, according to a preferred embodiment of the present invention, a first recording material is applied onto a medium through operation of a first recording mechanism at step 402. In addition, a second recording material is applied onto the print medium through operation of a second recording mechanism at step 404. Steps 402 and 404 may be performed concurrently or sequentially depending upon the compositions of the first and second materials as well as the type of printing operation the printer device has received. For example, steps 402 and 404 may be performed concurrently in a situation where the printing operation requires application of various fluids that may not be applied onto the print medium by a single type of printhead, e.g., the application of both thermal inkjet type fluids and fluids that are incompatible with thermal inkjet printheads as described hereinabove. As another example, steps 402 and 404 may be performed sequentially in a situation where the printing operation requires application of an undercoat prior to application of a fluid to create an image.

The first recording mechanism may comprise one of a thermal inkjet printhead and a piezoelectric printhead. In addition, the second recording mechanism may comprise one of a thermal inkjet printhead and a piezoelectric printhead, so long as the second recording mechanism is the alternate to the first recording mechanism. For example, if the first recording mechanism is a thermal inkjet printhead, the second recording mechanism is a piezoelectric printhead. The order in which the first recording mechanism and the second recording mechanism is operated is not critical to the operation of the principles of the present invention. Rather, the order of operation is a function of the desired printing operation and will vary according to the specific needs of various printing operations. As an example, for a printing operation that calls for the piezoelectric printheads to apply a fluid to create a background color and the thermal inkjet printheads to apply a fluid to create a relatively high resolution image either on or around the background, the piezoelectric printheads and the thermal inkjet printheads may be operated substantially concurrently.

Figure 4B:
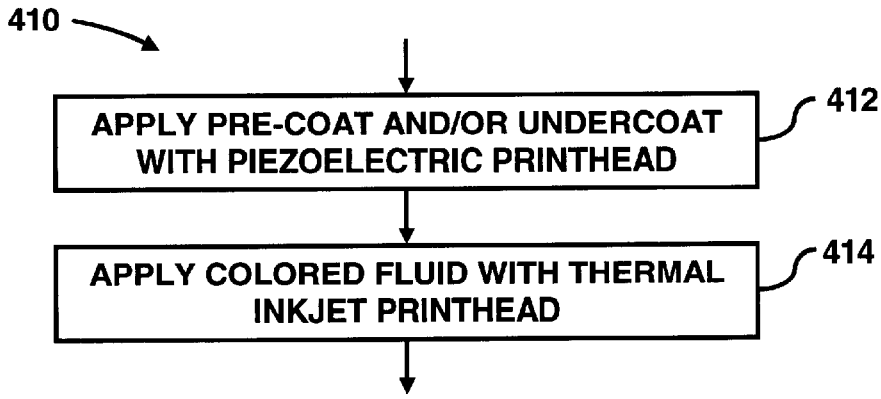

In FIG. 4B, there is illustrated a flow diagram 410 of an exemplary manner in which one embodiment of the present invention may be practiced. The flow diagram 410 may comprise a recurring subroutine configured to repeat according to a desired program. The flow diagram 410 may be operated in the manner described hereinabove for the flow diagram 400 illustrated in FIG. 4A. More specifically, at step 412, a pre-coat and/or an undercoat may be applied onto a print medium with a piezoelectric printhead. At step 414, a colored fluid may be applied onto the print medium with a thermal inkjet printhead. The pre-coat and/or the undercoat and the colored fluid may be applied during the same printing pass, or, in a multi-pass printing operation, the pre-coat and/or undercoat may be applied during various passes. In one respect, the pre-coat and/or the undercoat may be configured to interact with the colored fluid in a variety of different ways. For example, the pre-coat and/or the undercoat may comprise a chemical configured to enhance the aesthetic qualities of the colored fluid, increase its durability, etc.

Figure 4C:
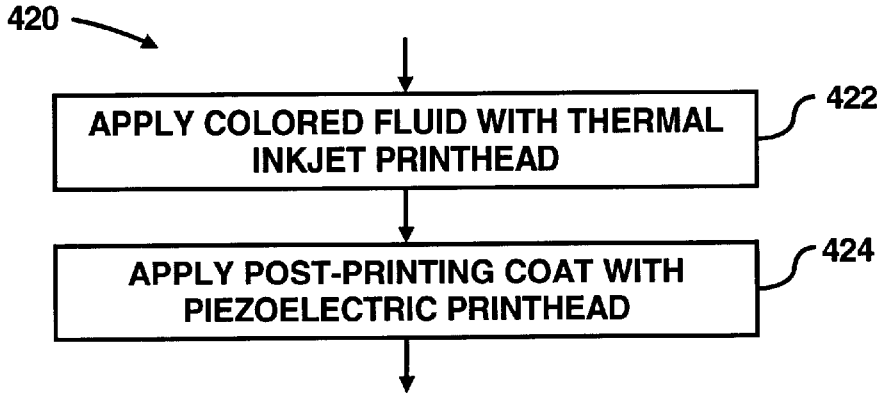

In FIG. 4C, there is illustrated a flow diagram 420 of an exemplary manner in which one embodiment of the present invention may be practiced. The flow diagram 420 may comprise a recurring subroutine configured to repeat according to a desired program. The flow diagram 420 may be operated in the manner described hereinabove for the flow diagram 400 illustrated in FIG. 4A. In this embodiment, a colored fluid may be applied onto the print medium to create an image with a thermal inkjet printhead at step 422. At step 424, a post-printing coat may be applied over the fluid applied by the thermal inkjet printhead with a piezoelectric printhead. In a similar manner to that described hereinabove with respect to FIG. 4B, the post-printing coat may be configured to interact with the colored fluid in a variety of different ways. For example, the post-printing coat may provide a glossy finish or laminate over the colored fluid.

In addition, the steps illustrated in FIGS. 4B and 4C may be combined in a single operation. That is, the piezoelectric printhead may be implemented to apply both a pre-coat and/or undercoat and a post-printing coat, as well as spot colored fluids, during a single printing operation. Moreover, application of the pre-coat and/or undercoat and the post-printing coat may be applied during the same printing pass as the application of the colored fluid or they may be applied during different passes.

Although the descriptions hereinabove with respect to FIGS. 4A–4C make specific reference to a single thermal inkjet printhead and a single piezoelectric printhead, it should be understood that the present invention may include any reasonably suitable number of thermal inkjet printheads and piezoelectric printheads. It should also be understood that the abilities of the printer device to create varying types of printed products greatly increases with any increase in the number of printheads implemented.

At least by virtue of the use of different fluid delivery mechanisms, the capabilities of a printer device may be substantially expanded. For example, the printer device according to the present invention may be implemented to produce printed products that possess characteristics beyond those currently obtainable in printer devices that utilize only a single type of fluid delivery mechanism. In one respect, not only is the color gamut increased, the types and characteristics, e.g., different finishes, fastness, etc., of the printed output is also increased. Another benefit of certain aspects of the present invention is that both the piezoelectric and thermal inkjet printing operations may be accomplished during a single printing operation, thereby obviating the need to perform separate printing operations with the thermal inkjet and piezoelectric printheads. One result of this may be that the throughput of the printer device may be increased.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A printer device comprising:

a first recording mechanism of a first type, operable to deliver a first recording material to a recording medium according to a first manner of delivery; and a second recording mechanism of a second type different from the first type, operable to deliver a second recording material to said recording medium according to a second manner of delivery, wherein said second manner of delivery of said second recording material from said second recording mechanism is substantially different than said first manner of delivery of said first recording material from said first recording mechanism;

wherein said first recording mechanism comprises a thermal inkjet printhead and said second recording mechanism comprises a piezoelectric printhead.

2. The printer device according to claim 1, wherein said thermal inkjet printhead is connected to a supply of said first recording material, and wherein said first recording material comprises a water-based colored fluid.

3. The printer device according to claim 2, wherein said first recording material comprises a material having a process color and said second recording material comprises a material having a spot color.

4. A method for printing onto a recording medium comprising;

applying a first recording material onto said recording medium with a first type of recording mechanism; and applying a second recording material onto said recording medium with a second different type of recording mechanism, wherein a manner of applying said first recording material substantially differs from said manner of applying said second recording material, and further comprising:

applying said first recording material onto said recording medium with a piezoelectric printhead and applying said second recording material onto said recording medium with a thermal inkjet printhead.

5. The method according to claim 4, wherein said step of applying said second recording material comprises the step of applying a material comprising a process color onto said recording medium.

6. The method according to claim 4, wherein said step of applying said first recording material comprises the step of applying a material comprising a spot color onto said recording medium.

7. The method according to claim 4, wherein said step of applying said first recording material comprises applying a material comprising a fluid utilized in silkscreen textile printing or a fluid that is utilized in industrial printing.

8. A printer device comprising:

one or more first recording mechanism of a first type, the one or more first recording mechanism being configured to deliver recording material to a recording medium; and at least one or more second recording mechanism of a second type operably associated with the one or more first recording mechanism, the second type being different from the first type, the one or more second recording mechanism being configured to deliver recording material to the recording medium, wherein the one or more first recording mechanism comprises a thermal inkjet printhead, and the one or more second recording mechanism comprises a piezoelectric printhead.

9. A printer device comprising:

one or more first recording mechanism of a first type, the one or more first recording mechanism being configured to deliver a first type of recording material to a recording medium; and at least one or more second recording mechanism of a second type operably associated with the one or more first recording mechanism, the second type being different from the first type, the one or more second recording mechanism being configured to deliver a second type of recording material to the recording medium, the second type of recording material being different from the first type of recording material;

wherein the one or more first recording mechanism comprises a thermal inkjet printhead, and the one or more second recording mechanism comprises a piezoelectric printhead.

10. A method comprising:

using a printer, applying a recording material onto a recording medium using a first type of recording mechanism; and using the printer, applying a recording material onto said recording medium using a second different type of recording mechanism;

wherein one of said acts of applying is performed using a recording mechanism comprising a thermal inkjet printhead, and the other of said acts of applying is performed using a recording mechanism comprising a piezoelectric printhead.

* * * * *

UNITED STATES PATENT AND TRADEMARK OFFICE

CERTIFICATE OF CORRECTION

PATENT NO. : 6,644,784 B2
DATED : November 11, 2003
INVENTOR(S) : Van Veen et al.

It is certified that error appears in the above-identified patent and that said Letters Patent is hereby corrected as shown below:

Column 4,
Line 50, replace "DesignJet.RTM." with -- DesignJet® --.

Signed and Sealed this

Eighteenth Day of May, 2004

JON W. DUDAS
*Acting Director of the United States Patent and Trademark Office*